US011867009B2

(12) United States Patent
Saeed et al.

(10) Patent No.: US 11,867,009 B2
(45) **Date of Patent: *Jan. 9, 2024**

(54) AUTONOMOUS DOWNHOLE ROBOTIC CONVEYANCE PLATFORM

(71) Applicant: Saudi Arabian Oil Company, Dhahran (SA)

(72) Inventors: Abubaker Saeed, Dhahran (SA); Jeffrey Shasho, Brooklyn, NY (US); Shazad Sadick, Brooklyn, NY (US)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 109 days.

This patent is subject to a terminal disclaimer.

(21) Appl. No.: 16/993,515

(22) Filed: Aug. 14, 2020

(65) Prior Publication Data

US 2022/0049561 A1 Feb. 17, 2022

(51) Int. Cl.
*E21B 23/00* (2006.01)
*E21B 49/00* (2006.01)

(52) U.S. Cl.
CPC ..... *E21B 23/001* (2020.05); *E21B 49/00* (2013.01)

(58) Field of Classification Search
CPC ..... E21B 23/001; E21B 49/00
See application file for complete search history.

(56) References Cited

U.S. PATENT DOCUMENTS

| | | | | |
|---|---|---|---|---|
| 7,156,192 | B2 * | 1/2007 | Guerrero | E21B 23/14 175/90 |
| 9,690,989 | B2 * | 6/2017 | Hay | E21B 49/08 |
| 9,885,218 | B2 | 2/2018 | Heijnen et al. | |
| 9,945,190 | B2 * | 4/2018 | Crowley | E21B 47/12 |

(Continued)

FOREIGN PATENT DOCUMENTS

| | | | |
|---|---|---|---|
| CN | 102720477 | A | 10/2012 |
| CN | 104634373 | A | 5/2015 |
| CN | 108868603 | B | 12/2019 |

OTHER PUBLICATIONS

"Autonomous Tractoring." Offshore Engineer Magazine, Mar. 11, 2014, www.oedigital.com/component/k2/item/5204-autonomous-tractoring). 3 pages.

(Continued)

*Primary Examiner* — D. Andrews
(74) *Attorney, Agent, or Firm* — Leason Ellis LLP

(57) ABSTRACT

A modular mobility platform has extendable and retractable tractor treads for engaging the walls of a downhole environment. The extendable and retractable tractor treads allow the platform to successfully navigate longitudinally through the downhole environment. The platform is composed of a plurality of different modules removably interconnected together longitudinally. Each module has at least one specific function, such as sensing, navigation, mobility, control, communication, power, or a combination thereof. The platform has longitudinally-directed detectors for detecting the forward or reverse direction through which the platform is to travel. A front end of the platform having a sensor at the forward end thereof articulates to navigate the mobility platform laterally through splits in the downhole environment. A system and method use the modular mobility platform.

20 Claims, 9 Drawing Sheets

(56) References Cited

U.S. PATENT DOCUMENTS

| | | | | |
|---|---|---|---|---|
| 2006/0180318 | A1 | 8/2006 | Doering et al. | |
| 2012/0313790 | A1* | 12/2012 | Heijnen | E21B 23/14 340/854.6 |
| 2016/0281450 | A1 | 9/2016 | Bloom et al. | |
| 2019/0070726 | A1 | 3/2019 | Bilsky | |
| 2020/0055196 | A1* | 2/2020 | Halpenny | B25J 15/0019 |
| 2020/0116884 | A1 | 4/2020 | Weng et al. | |
| 2020/0300053 | A1* | 9/2020 | Fernandes | F16L 55/46 |
| 2021/0189819 | A1* | 6/2021 | Christie | E21B 19/22 |

OTHER PUBLICATIONS

Rudakevych, Pavlo. "Fuel Cells for Robots." Office of Energy Efficiency & Renewable Energy, www1.eere.energy.gov/hydrogenandfuelcells/pdfs/128.pdf. 25 pages.

* cited by examiner

AUTONOMOUS DOWNHOLE ROBOTIC CONVEYANCE PLATFORM

FIELD OF THE DISCLOSURE

The present disclosure relates generally to geological drilling and downhole procedures, and, more particularly, to a modular mobility platform configured to travel through and navigate diverse downhole environments, and to a system and method using such a modular mobility platform.

BACKGROUND OF THE DISCLOSURE

During procedures in geological environments, such as a downhole of a well or pipe, it is advantageous to explore the environment and to inspect the walls of the well using robots or mobility platforms having electronic-based instruments. However, travel of a robot through a downhole longitudinally, such downhole environments has presented a challenge to known robots, since the lateral width within such environments can various substantially. Accordingly, the sides of the robot can brush against or collide with the walls, potentially damaging the robot and its instruments.

Many robots in the prior art also have a fixed structure, such as a housing for retaining a fixed set of motors for travel, as well as a fixed set of instruments for monitoring and inspecting the downhole environment. However, once such robots are constructed, the robot cannot be modified without disassembling the robot, if possible. Therefore, a robot in the prior art is limited to its motors and instruments included during construction.

Some robots in the prior art are configured in a fixed elongated form to travel up or down the downhole environment which is usually longitudinally extended. However, some downhole environments can have branches and turns, preventing the fixed elongated configuration of the robot from navigating such branches and turns.

There are other limitations of known robots that have been used in downhole environments. It is to these constraints that the present disclosure is directed.

SUMMARY OF THE DISCLOSURE

According to an embodiment consistent with the present disclosure, a modular mobility platform has extendable and retractable tractor treads for engaging the walls of the downhole environment. Such tractor treads allow the platform to successfully navigate longitudinally through the downhole environment. Moreover, the platform can be composed of a plurality of different modules removably interconnected together longitudinally. Each module can have a specific function, such as sensing, navigation, mobility, control, communication, and power. The platform can have generally longitudinally-directed detectors for detecting the forward or reverse direction through which the platform is to travel. The present disclosure also includes a system and method using such a modular mobility platform. The platform can also be elongated with the capability of articulating in a lateral direction relative to a longitudinal axis of the platform in order for the platform to travel laterally.

In an embodiment consistent with the disclosure, a mobility platform capable of traveling in a downhole environment, comprises a plurality of interconnected modules including at a forward end of the modules a navigation module, wherein the navigation module is configured by a processor executing code therein to detect a feature of the downhole environment and direct the plurality of interconnected modules comprising the mobility platform toward the feature within the downhole environment, the navigation module including: an articulating arm; a sensor disposed at a forward end of the articulating arm configured to detect the feature of the downhole environment; and an actuator connected to bend the articulating arm in a selected lateral direction; a computing module among the plurality of interconnected modules, the computing module being configured by a processor executing code therein to determine, from the feature, a first width of an upcoming portion of the downhole environment; and a drive module among the plurality of interconnected modules, the drive module having extendable and retractable tractor treads; wherein the computing module is further configured to: control the drive module to extend or retract the tractor treads to have the drive module with a second width less than a first width to fit the mobility platform in the upcoming portion in the selected direction, and control the drive module to drive the tractor treads to move the mobility platform in the upcoming portion in the selected direction. The navigation module, computing module, and drive module are linearly interconnected.

In certain embodiments consistent with the disclosure, the navigation module, computing module, and drive module are removably interconnected. In certain embodiments, each of the navigation module, computing module, and drive module have housings that are substantially cylindrical with a respective module longitudinal axis. In the same or different embodiments, the navigation module, computing module, and drive module are interconnected with the respective module longitudinal axes substantially aligned to form the mobility platform and to define a substantially cylindrical shape along a mobility platform longitudinal axis.

In certain embodiments consistent with the disclosure, the sensor emits a detection signal in a forward direction for detecting the feature in the downhole environment, such as in a selected lateral direction. The detection signal includes ultrasonic waves. The computing module controls the drive module using wireless signals.

In another embodiment consistent with the disclosure, a mobility platform capable of traveling in a downhole environment, comprises: a plurality of interconnected modules including at a forward end of the modules a navigation module, wherein the navigation module is configured by a processor executing code therein to detect a feature of the downhole environment and direct the plurality of interconnected modules comprising the mobility platform toward the feature within the downhole environment, the navigation module including: an articulating arm; sensor disposed at a forward end of the articulating arm configured to detect the feature, and an actuator connected to bend the articulating arm in a selected lateral direction; a computing module among the plurality of interconnected modules, the computing module being configured by a processor executing code therein to determine a first width of an upcoming portion in the selected direction; and a drive module among the plurality of interconnected modules, the drive module having extendable and retractable tractor treads; wherein the computing module is further configured to: control the actuator to bend the articulating arm in the selected lateral direction to direct the articulating arm toward the upcoming portion of the downhole environment, control the drive module to extend or retract the tractor treads to have the drive module with a second width less than a first width to fit the mobility platform in the upcoming portion in the selected direction, and control the drive module to drive the tractor treads to move the mobility platform in the upcoming portion in the selected direction. The sensor emits a detection signal in the lateral direction for detecting the feature. The detection signal includes ultrasonic waves. The navigation module, computing module, and drive module are interconnected. The navigation module, computing module, and drive module can be removably interconnected.

In certain embodiments consistent with the disclosure, each of the navigation module, computing module, and drive module have housings that are substantially cylindrical with a respective module longitudinal axis. In the same or different embodiments, the navigation module, computing module, and drive module are interconnected with the respective module longitudinal axes substantially aligned to form the mobility platform and to define a substantially cylindrical shape along a mobility platform longitudinal axis. The tractor treads are extended or retracted laterally relative to the mobility platform longitudinal axis. The computing module controls the drive module using wireless signals.

In a further embodiment consistent with the disclosure, a method, comprises: interconnecting a plurality of modules, the plurality of modules including a computing module, a drive module and, at a forward end of the modules, a navigation module, wherein the navigation module is configured by a processor executing code therein to detect a feature of the downhole environment and direct the plurality of interconnected modules comprising the mobility platform toward the feature with the downhole environment, the navigation module including an articulating arm, a sensor disposed at a forward end of the articulating arm configured to detect the feature, and an actuator connected to bend the articulating arm in a selected lateral direction, wherein the computing module being configured by a processor executing code therein to determine a first width of an upcoming portion in the selected direction, wherein the drive module has extendable and retractable tractor treads, wherein the computing module is further configured to control the drive module to extend or retract the tractor treads to have the drive module with a second width less than the first width to fit the mobility platform in the upcoming portion in the selected direction, and control the drive module to drive the tractor treads to move the mobility platform in the upcoming portion in the selected direction; deploying the mobility platform into the downhole environment; detecting the feature of the downhole environment; determining the first width of the upcoming portion of the downhole environment; moving a tractor tread of the drive module to fit the mobility platform into the upcoming portion; and advancing the mobility platform into the upcoming portion of the downhole environment. Moving the tractor tread comprises either extending the tractor tread from the drive module or retracting the tractor tread toward the drive module prior to advancing the mobility platform into the upcoming portion of the downhole environment.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

It is noted that the drawings are illustrative and are not necessarily to scale.

DETAILED DESCRIPTION OF CERTAIN EMBODIMENTS OF THE DISCLOSURE

Example embodiments consistent with the teachings included in the present disclosure are directed to a modular mobility platform capable of traveling through diverse downhole environments, including environments with branched and turned passageways which are situated laterally of a main bore hole, as well as a system and method using such a modular mobility platform.

As shown in FIGS. 1-9, the mobility platform 10 includes a plurality of interconnected modules 12-32 for traveling through downhole environments having diverse geometries. The modules 12-32 each have respective housings that are generally are sized so that the overall shape of the mobility platform 10 is adapted for movement through a bore hole. More particularly, the mobility platform 10 defines a generally cylindrical robot, as illustrated, in which the discrete housings of the respective modules can each be cylindrical and elongated along the longitudinal axis of the mobility platform 10. When interconnected with one end of a module to an end of another module, the modules 12-32 constitute the mobility platform 10. The modules 12-32 can be removably connected such that the modules 12-32 are secured to each other to form the platform 10. Such cylindrical and elongated configurations of the platform 10 and its modules 12-32 have a common longitudinal axis, and a minimum lateral width of, for example, about 2.585 inches (about 6.566 cm.). Such a minimum lateral width allows the platform 10 to pass through a downhole environment provided that the width of the current portion of the downhole environment is greater than that of the mobility platform 10.

Figure 1:
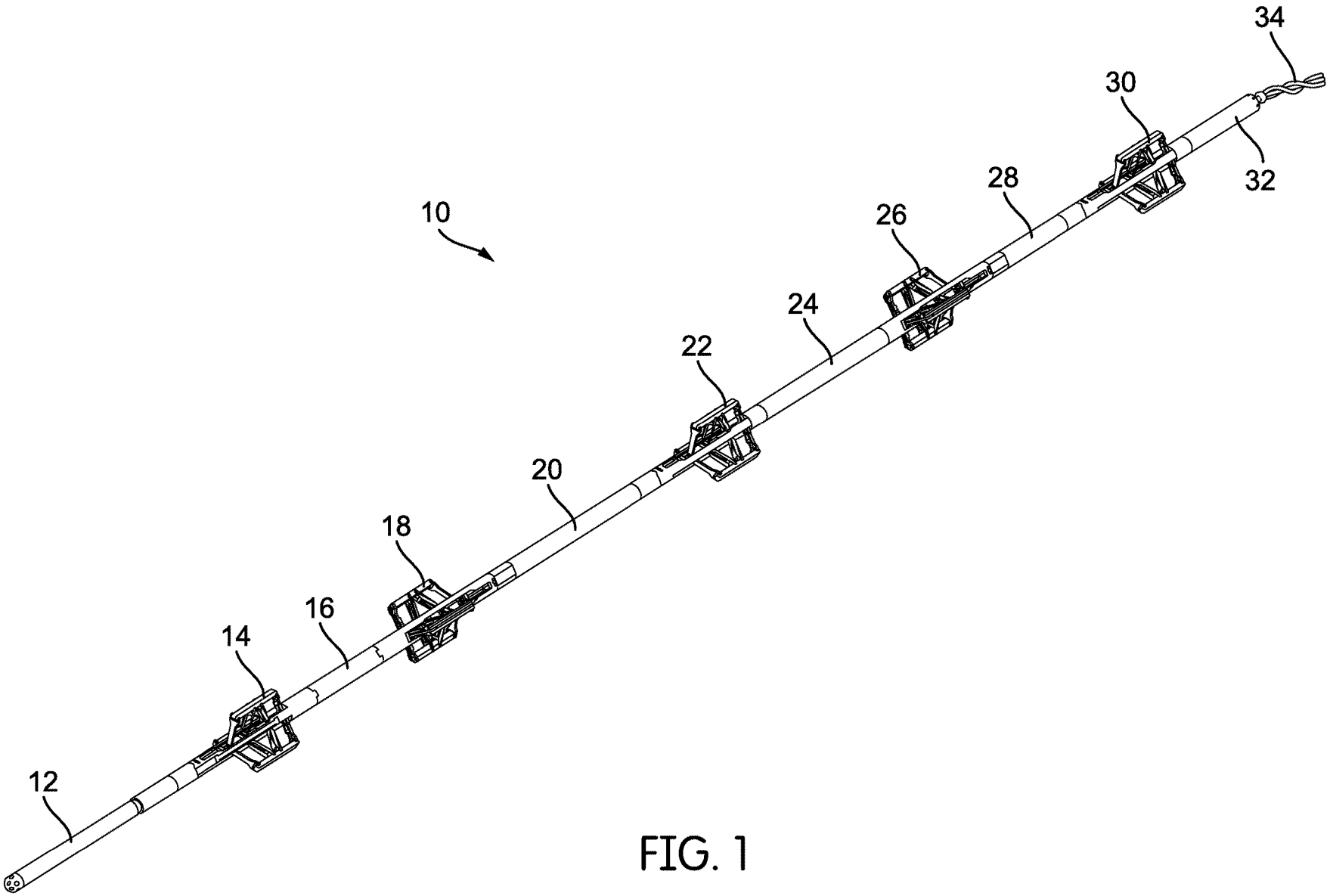
FIG. 1 is a top front side perspective view of a mobility platform with tractor treads in an extended configuration according to an embodiment.

The mobility platform 10 carries instruments suitable for navigating and inspecting the downhole environments. Referring to FIG. 1, the modules can include a front sensor module 12, a first drive module 14, a first computing module 16, a second drive module 18, a first power module 20, a third drive module 22, a second power module 24, a fourth drive module 26, a second computing module 28, a fifth drive module 30, and a rear sensor module 32 which is attached to a tether 34 from a rig above ground on the surface of the Earth. The front sensor module 12 is positioned at a front end of the platform 10, and the rear sensor module 32 is positioned at a rear end of the platform 10. Through the tether 34, the rear sensor module 32 can provide power from the rig to at least the fifth drive module 30. In different configurations, embodiments can be arranged with additional or fewer modules; however, in accordance with a salient aspect of the disclosure, at least the front sensor module 12 is included in all embodiments with an articulated connection to at least one other module, if not several additional modules to constitute a given embodiment of the mobility platform 10.

Figure 2:
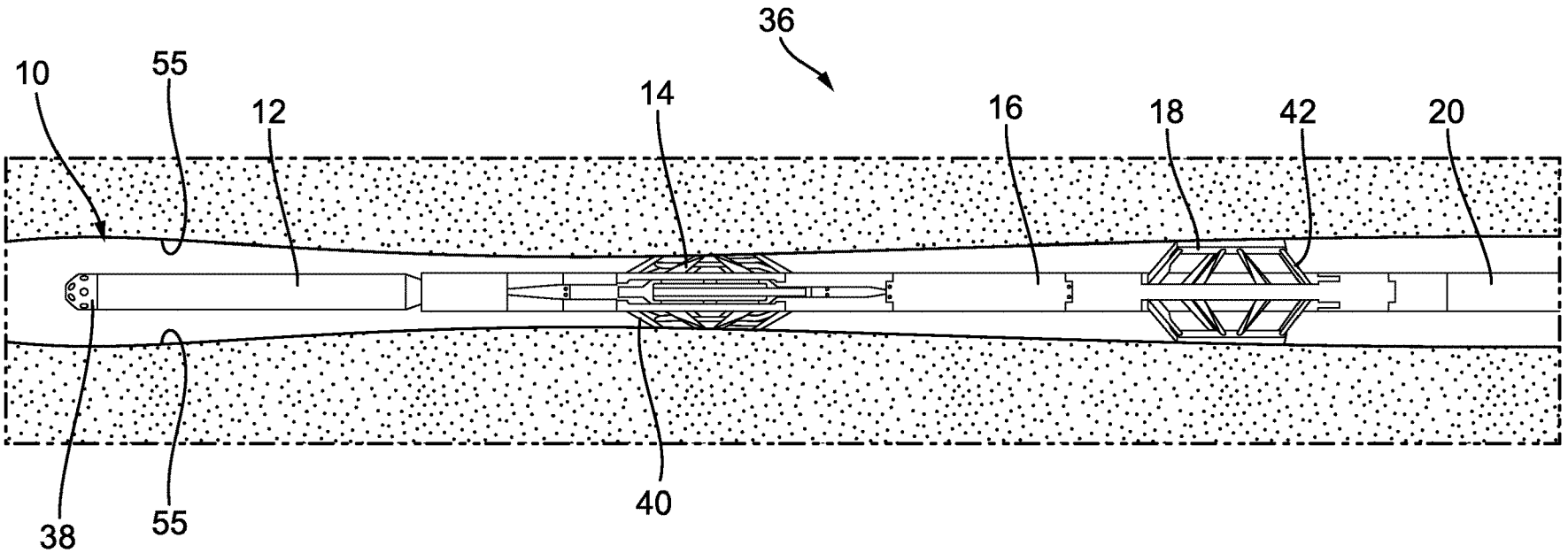
FIG. 2 is a side elevational view of the mobility platform of FIG. 1 with one set of tractor treads in a fully extended configuration, and another set of tractor treads in a partially extended configuration.

The front sensor module 12 and the rear sensor module 32 can include a housing with apertures through which a respective sensor can detect the downhole environment 36 and local geological geometry at the front end or the rear end of the platform 10, respectively, such as shown in FIG. 2. As with other modules described herein, each is associated with a hardware processor and a memory unit which contains code. The code is loaded from the memory into the processor and configures the processor to implement the functionality of the respective module, such as the front sensor module 12 and the rear sensor module 32.

The front sensor module 12 is described in greater detail below with reference to FIGS. 6-9, and the rear sensor module 32 is described in greater detail below with reference to FIGS. 5-7. Using sensors, such as the sensor 38, the platform 10 can operate in an autonomous mode, under control of code executing in one or more processors, to move forward and reverse, and to navigate through the downhole environment 36, with an arrangement as shown in FIGS. 2 and 9. In addition, the sensors can detect a constriction 40 or expansion 42 within the downhole environment 36, as shown in FIG. 2, and can retract tractor treads, such as the tractor treads on the drive module 14, or can extend tractor treads, such as the tractor treads on the drive module 18. Such retracted or extended tractor treads engage the walls of the constriction 40 or expansion 42, respectively, to ensure friction between the tractor treads and the walls. Driving the tractor treads then moves at least the drive modules 14, 18 through the constriction 40 or expansion 42, and therefore moves the mobility platform 10 through the downhole environment 36.

Alternatively, the data from the sensors on the front sensor module 12 and the rear sensor module 32 can be relayed to an operator outside of the downhole, such as in a position on the surface of the Earth. Accordingly, the platform 10 can operate in a semi-autonomous mode by which the operator processes the sensor data, and instructs the platform 10, through communications transmitted through the tether 34, to move forward or backward within the downhole environment. As such, in this alternative arrangement, the platform 10 operates under control of code executing in one or more processors and, further, in compliance with any commands that may have been received from the user. In a further alternative embodiment, constructed with at least one processor executing locally on the platform 10, the operator instructs the platform 10 using signals provided to the computing modules 16, 28 to locally control the movement of the platform 10. Such signals can be radio waves.

Figure 3:
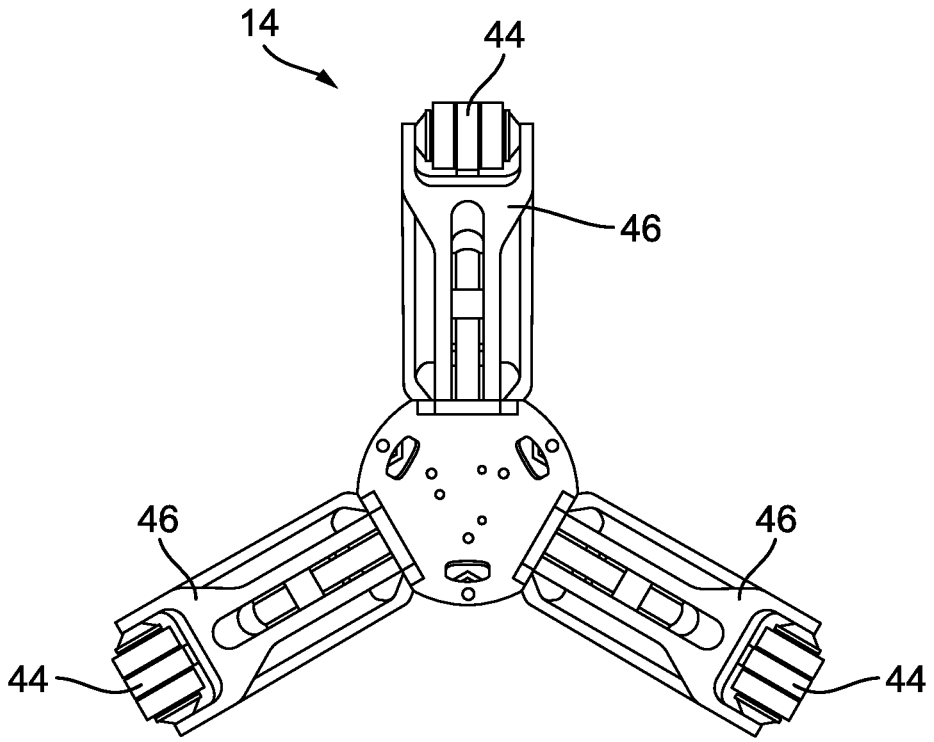
FIG. 3 is a forward elevational view of the mobility platform in the fully extended configuration of FIG. 1.
Figure 4:
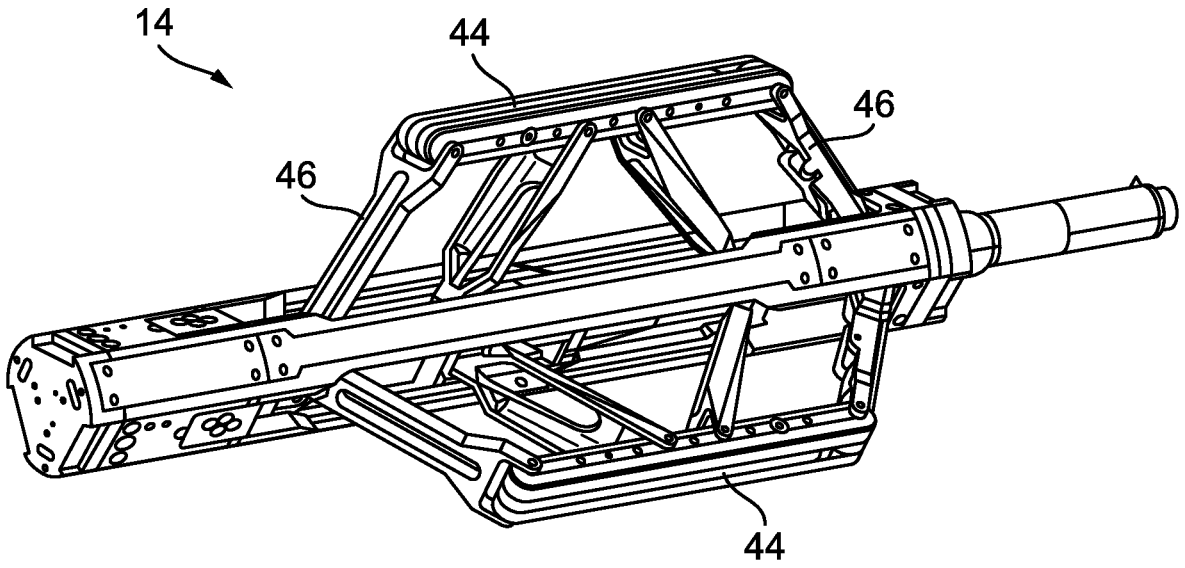
FIG. 4 is a top front side perspective view of a drive module with the tractor treads extended.

Referring again to FIG. 1, each of the drive modules 14, 18, 22, 26, 30, such as the drive module 14, can include tractor treads 44, as shown in FIGS. 3-4, which can be retracted or extended laterally relative to the longitudinal axis. In the example embodiment of FIGS. 1-2, the retraction and extension of the tractor treads 44, as well as the motive operation of the tractor treads 44 is controlled by the computing modules 16, 28. The computing modules 16, 28 are associated with a hardware processor and a memory unit which contains code, and this can be the same processor and memory used by other modules, or a different processor and memory. The computing module implements code loaded from the memory which configures the processor to implement the functionality of the computing modules 16, 28, including control of a drive module or of plural drive modules. In an alternative embodiment, since the platform 10 is modular, the platform 10 can accommodate any number of drive modules such as the drive modules 14, 18, 22, 26, 30 required for the specific application of the platform 10 in the downhole environment. For example, modules can be linked together with one computing module for every two drive modules, such as the first computing module 16 associated with the drive modules 14, 18, and the second computing module 28 associated with the drive modules 26, 30. A computing module controls the associated drive modules adjacent to that computing modules. Alternatively, a computing module can be associated with and can control a drive module which is not adjacent to that specific computing module. For example, as shown in FIG. 1, the drive module 22 is associated with and controlled by a nearest computing module, such as the computing module 16.

In an embodiment, each drive module can be powered by an adjacent power module, such as the power module 20 providing electrical power to the adjacent drive modules 18, 22, and the power module 24 which provides electrical power to the adjacent drive module 26. Alternatively, the drive module 22 can receive electrical power from the power module 24. The power modules 20, 24 have batteries which feed electrical power to associated drive modules. Any drive modules which are not adjacent to a power module can include batteries within a respective drive module. Such batteries can be rechargeable. Alternatively, for any drive module attached to the rear sensor module 32, such as the drive module 30 in FIG. 1, power can be supplied directly to the drive module 30 by electrical connections through the rear sensor module 32 from the tether 34. In a further alternative embodiment, power supplied from the tether 34 through the rear sensor module 32 can charge a rechargeable battery internal to the drive module 30. Power can be conveyed to each of the respective modules by an electrical connection associated with the interconnection of any particular arrangement of modules.

As stated above, the various modules with specific functions can be removably interconnected depending on the specific applications for the deployed mobility platform 10. The specific applications can include cameras and other types of detectors which are laterally oriented on a computing module for inspecting the walls of the well or pipe. Alternatively, the lateral cameras and detectors can be included in a detection module configured differently from the computing module. An alternative application can include a repair module having laterally retractable and extendable arms with code executing in a processor thereof which enables tools associated with the repair module to engage and repair a wall of the well or pipe, such as by welding, sealing, or shoring up the material of the bore hole walls or the pipe.

In an embodiment, shown in FIGS. 3-4, each drive module, such as the drive module 14, has three tractor treads 44 mounted on the retractable and extendable arms 46. The three tractor treads of a specific drive module are spaced about the longitudinal axis by, for example, about 120°, as shown in FIGS. 3-4. Such angular differences between the treads of a specific drive module provide greater stability of the respective drive module when the arms including the treads of the respective drive module are extended and pre-loaded against the downhole walls. In an alternative embodiment, a drive module can have two tractor treads spaced about the longitudinal axis by about 180°. In a further alternative embodiment, a drive module can have four tractor treads spaced about the longitudinal axis by about 90°. In additional alternative embodiments, a drive module with at least two tractor treads can have such tractor treads spaced about at diverse angles. In an example of such diverse angular configurations, the three tractor treads 44 of the first drive module 14 in FIGS. 3-4 can alternatively have two tractor treads spaced about the longitudinal axis by about 180°, and the third tractor tread spaced about the longitudinal axis by about 90° from the other two tractor treads, forming a "T" configuration of tractor treads.

In an embodiment as shown in FIG. 1, at least one drive module 18 is configured to have the tractor treads rotated by an angle relative to the longitudinal axis and relative to the tractor treads of the first drive module 14, such as being rotated at an angle of about 60°. Such angular differences between the treads of different drive modules provide greater stability of the overall platform 10 when the arms including the treads are extended and pre-loaded against the downhole walls.

Each drive module 14, 18, 22, 26, 30 has two subsystems: a preload system and a drive system. The drive system actuates the treads on each of the modules 14, 18, 22, 26, 30, respectively, using a worm-gear drive, allowing the platform 10 to move longitudinally forward and backward. The drive module(s) are associated with a hardware processor and a memory unit which contains code. The code is loaded from the memory into the processor and configures the processor to implement the functionality of the drive modules 14, 18, 22, 26, 30, or can be associated with other modules, depending on the particular implementation approach.

Under control of code executing to implement each respective drive module, each of the treads on arms of the drive modules 14, 18, 22, 26, 30, respectively, can retract and extend independently, although the treads of a specific drive module are linked together by the worm gear drive for radial symmetry. Also under control of code executing to implement each respective drive module, the preload system controls the lateral distance of the platform 10 from the downhole walls by extending and retracting the arms of each drive module. The preload system and the drive system are actuated using one motor for each subsystem in the illustrated embodiment. Under control of code executing each respective drive module, a preload motor turns a leadscrew and applies a preload of the treads against the downhole wall by moving the arms radially. In addition, under control of code executing each respective module, a drive motor drives the mobility platform 10 to move forward or in reverse in a direction parallel to the mobility platform longitudinal axis by moving the treads.

The preload subsystem allows the arms having the treads to extend to accommodate the various diameters that the platform 10 is expected to have the ability to traverse, as well as to retract to be stowed during traversal of a narrow pipe, such as a XN-nipple. The preload subsystem translates the three treads radially towards/away from longitudinal axis. On each drive module, all three treads are coupled and move together. The treads cannot be extended or retracted individually. However, the preload subsystem for each drive module can cause all three tractor treads to be extended or retracted independently of the other drive modules of the platform 10.

Transversal of an XN-nipple requires at least two drive modules, since one of the drive modules needs to be extended and preloaded against the pipe wall to support the platform 10, while the other drive module is retracted to pass through the constriction of the XN-nipple. No matter how many drive modules are incorporated into a different configuration of the platform 10, the process of passing through a constriction remains the same. Each drive module retracts and passes through the XN-nipple while being supported by the other drive modules. Such retraction and extension of arms and treads can be performed for each drive module until the end of the platform 10 clears the constriction of a narrow downhole environment such as an XN-nipple. For transitioning between downhole environments of different lateral widths, such as illustrated in FIG. 2, the mobility platform 10 utilizes a continuous drive mechanism while traveling through a downhole environment, such as a pipe or an XN-nipple, under control of the program executing in its associated processor, optionally in compliance with any command from a user that may have been received. While moving from one downhole size to another, the platform 10, using one or more sensors in a suitably configured module such as the sensor modules 12, 30, detects the transition, and issues control signals to the computing modules 16, 28 to either retract or extend the treads on the arms of a respective drive module, depending on the transition type. In one example, the treads are retracted to pass through an XN-nipple and are extended to preload against open-hole or washout environments.

Referring to FIG. 1, the computing modules 16, 28 are positioned in intermediate locations among the various modules 12-32 of the platform 10. The computing modules 16, 28 include a housing for retaining a motor controller and a core processing unit ("processor," as previously described), and memory for storing code, settings, and data collected during the downhole travel, all connected to the motor controller. This is used to control the nearby drive modules associated with a respective computing module. The housing can be composed of aluminum. The computing modules 16, 28 can also include a separate heat sink thermally connected to the aluminum housing for dissipating heat during operation of the platform 10. In an alternative embodiment, a heat sink pattern is milled into an aluminum base of the computing modules 16, 28 to ensure good thermal contact and heat dissipation during operation of the platform 10. In an embodiment, the computing modules 16, 28 have no external sensors or effectors, and so are dedicated to communicating with and controlling other modules in the platform 10. In an alternative embodiment, the computing modules 16, 28 can include external sensors or effectors for detecting and performing actions, respectively, in intermediate locations in the downhole environment relative to the overall length of the platform 10.

Each end of the computing modules 16, 28 is connected to an adjacent drive module, respectively. The motor controller can be directly connected to the drive motor of an adjacent drive module. Accordingly, signals from the motor controller are communicated to the drive motor to control the application of electricity from the battery of the drive module to the drive motor. In an alternative embodiment, the motor controller and the drive motor can be connected to respective wireless communication units. Using the wireless communication units, the motor controller can wirelessly control the drive motor of the drive module. The wireless control can be performed using WiFi, Bluetooth™, or other known communication protocols. Using the motor controller and the core processing unit, the computing modules 16, 28 can perform local, closed loop motion and preload control by virtue of the logic being implemented by the code executing in the processor. In conjunction with data gathered from the sensor modules 12, 32, the platform 10 implements autonomous position estimation of the platform 10, downhole feature detection, and downhole feature navigation, or, in certain implementations, semi-autonomous downhole feature navigation in response to commands received from a remote user.

Using the data gathered from the front sensor module 12, the code executing in the processor of each of the computing modules 16, 28 determines a feature in an upcoming portion of the downhole environment. The code determines a width of the upcoming portion of the downhole environment from the feature. Each of the computing modules 16, 28 uses first predetermined logic implemented by the code executing in the processor. By using the first predetermined logic, the computing modules 16, 28 generates a first signal, transmitted to the drive modules, to extend or retract the arms and treads of respective drive modules to preload the treads against the walls of the downhole environment to fit the mobility platform 10 into the upcoming portion. Each of the computing modules 16, 28 uses second predetermined logic implemented by the code executing in the processor. By using the second predetermined logic, the computing modules 16, 28 generates a second signal, transmitted to the drive modules, to rotate the treads. The treads are preloaded against the walls of the downhole environment. Accordingly, the mobility platform 10 advances into the upcoming portion of the downhole environment.

Referring to FIGS. 5-8, the sensor modules 12, 32 includes a housing 48 with an aperture 50 in which is disposed at least one sensor 52. In an embodiment, the sensor modules 12, 32 have multiple sensors 52 spaced apart, which are connected to a processor. The processor implements code configured to interact with the sensors 52 to collect distance data. The processor has a wireless communication device for wirelessly transmitting the distance data from the sensor 52 to a respective computing module 16, 28. In addition, the wireless communication device receives control signals from the respective computing module 16, 28 for controlling the components within the respective sensor modules 12, 32. The wireless communication device has an antenna for transmitting and receiving signals using WiFi, Bluetooth™, or other known communication protocols.

Figure 7:
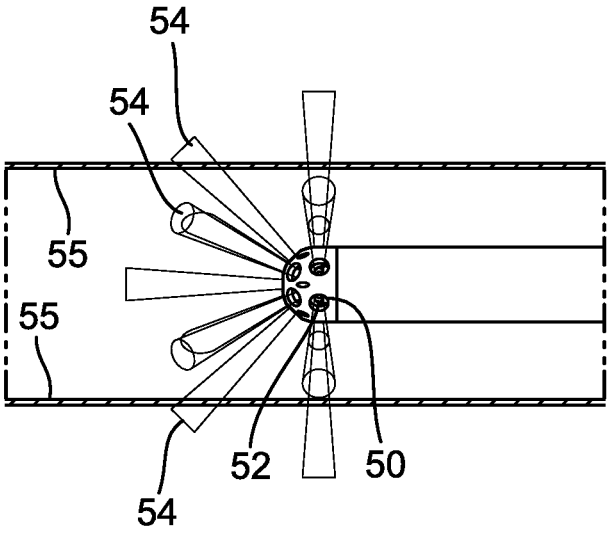
FIG. 7 is a side elevational view of a representation of the ranges of detection of a front sensor module.

Each sensor 52 operates as a range sensor and emits signals through the aperture 50, in a range 54 represented in FIG. 7. The emitted signals are transmitted in a forward direction at 0° as well as at acute forward angles relative to the longitudinal axis of the platform 10. The emitted signals can be light, radio waves, microwaves, or ultrasonic waves which are reflected by forward-located features in the downhole environment. In one particular embodiment, at least one sensor comprises a combination ultrasound transmitter and detector. In another embodiment, the transmitter and detector are discrete components, and are both configured to transmit and receive ultrasonic signals, respectively. The reflected signals (e.g., ultrasonic signals) are detected by the sensors 52 and converted in a conventional manner to be the distance data transmitted to the respective computing modules 16, 28. Each sensor 52 allows the platform 10 to estimate the width of the downhole environment, such as the walls 55, in front of the platform 10, which improves the fidelity of the preload system and allows for autonomous traversal of downhole environments with different widths, such as an XN-nipple.

Figure 5:
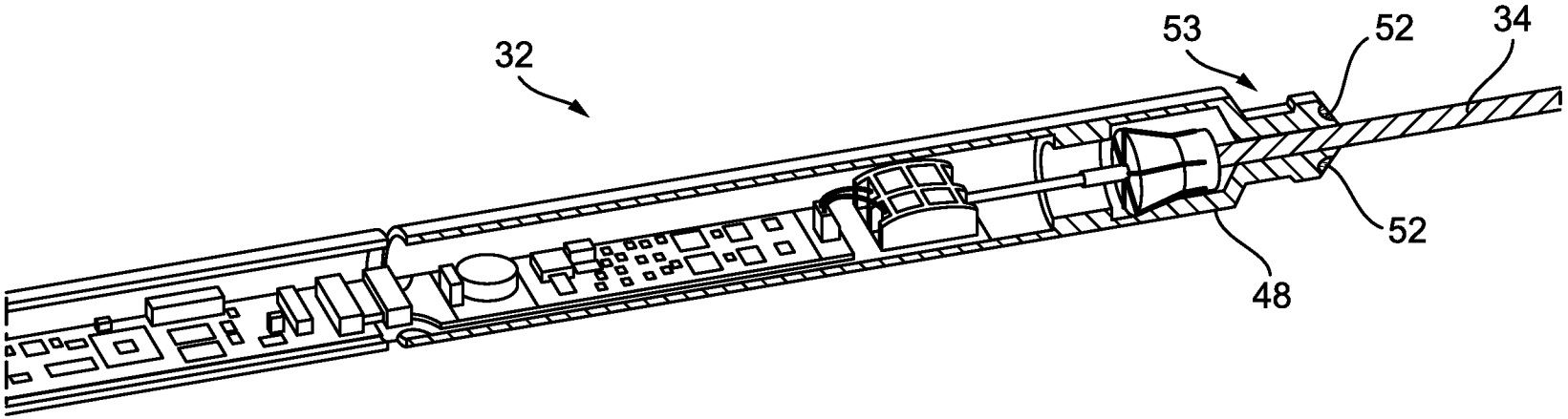
FIG. 5 is a side cross-sectional view of a rear sensor module.
Figure 6:
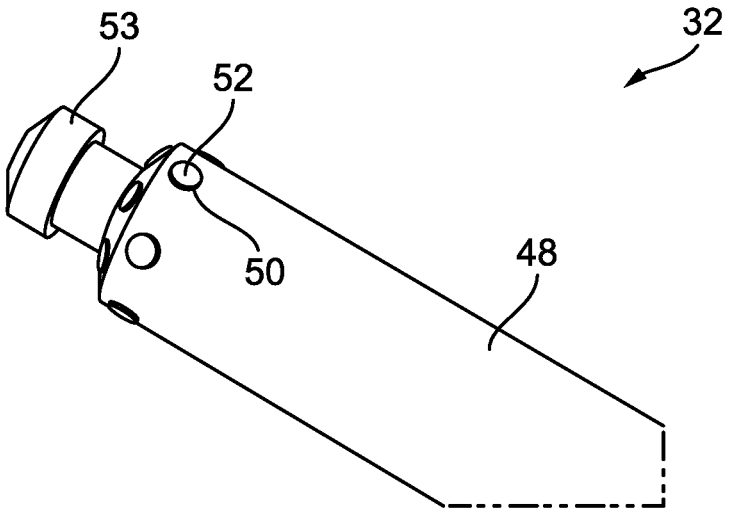
FIG. 6 is a side elevational view of an end of the rear sensor module of FIG. 5.

Referring to FIGS. 5-6, the rear sensor module 32, disposed in the rear end of the platform 10, can also include at least one sensor 52 which allows the platform 10 to detect rearward downhole features when the platform 10 moves rearward, for example, during extraction of the platform 10 from the downhole environment by a rig. Using the data gathered from the rear sensor module 30, the code executing in the processor of each of the computing modules 16, 28 determines a feature in an upcoming rearward portion of the downhole environment to the rear of the mobility platform 10. The code determines a width of the upcoming rearward portion of the downhole environment from the feature. Each of the computing modules 16, 28 uses first predetermined logic implemented by the code executing in the processor. By using the first predetermined logic, the computing modules 16, 28 generate a first signal, transmitted to the drive modules, to extend or retract the arms and treads of respective drive modules to preload the treads against the walls of the downhole environment to fit the mobility platform 10 into the upcoming rearward portion. Each of the computing modules 16, 28 uses second predetermined logic implemented by the code executing in the processor. By using the second predetermined logic, the computing modules 16, 28 generate a second signal, transmitted to the drive modules, to rotate the treads. The treads are preloaded against the walls of the downhole environment. Accordingly, the mobility platform 10 can retreat into the upcoming rearward portion of the downhole environment. For example, the retreat of the mobility platform 10 can be performed as the mobility platform 10 is extracted from the downhole environment.

In an embodiment, as shown in FIGS. 5-6, the rear sensor module 32 need not include as many sensors 52 as the front sensor module 12. In the illustrated embodiment a fishneck wireline interface 53 extends through the tether 34 and provides an interface with deployment and retrieval rigging equipment when the platform 10 is deployed into or extracted from, respectively, the downhole well or pipe. The interface 53 provides an in-situ mating and de-mating fishneck interface with the rigging equipment. In addition, the rear sensor module 32 includes a wireless communication device to uplink data to the platform 10 from an external console. Alternatively, at least one of the computing modules 16, 28 includes the wireless communication device to uplink data to the platform 10 from the external console.

Figure 8:
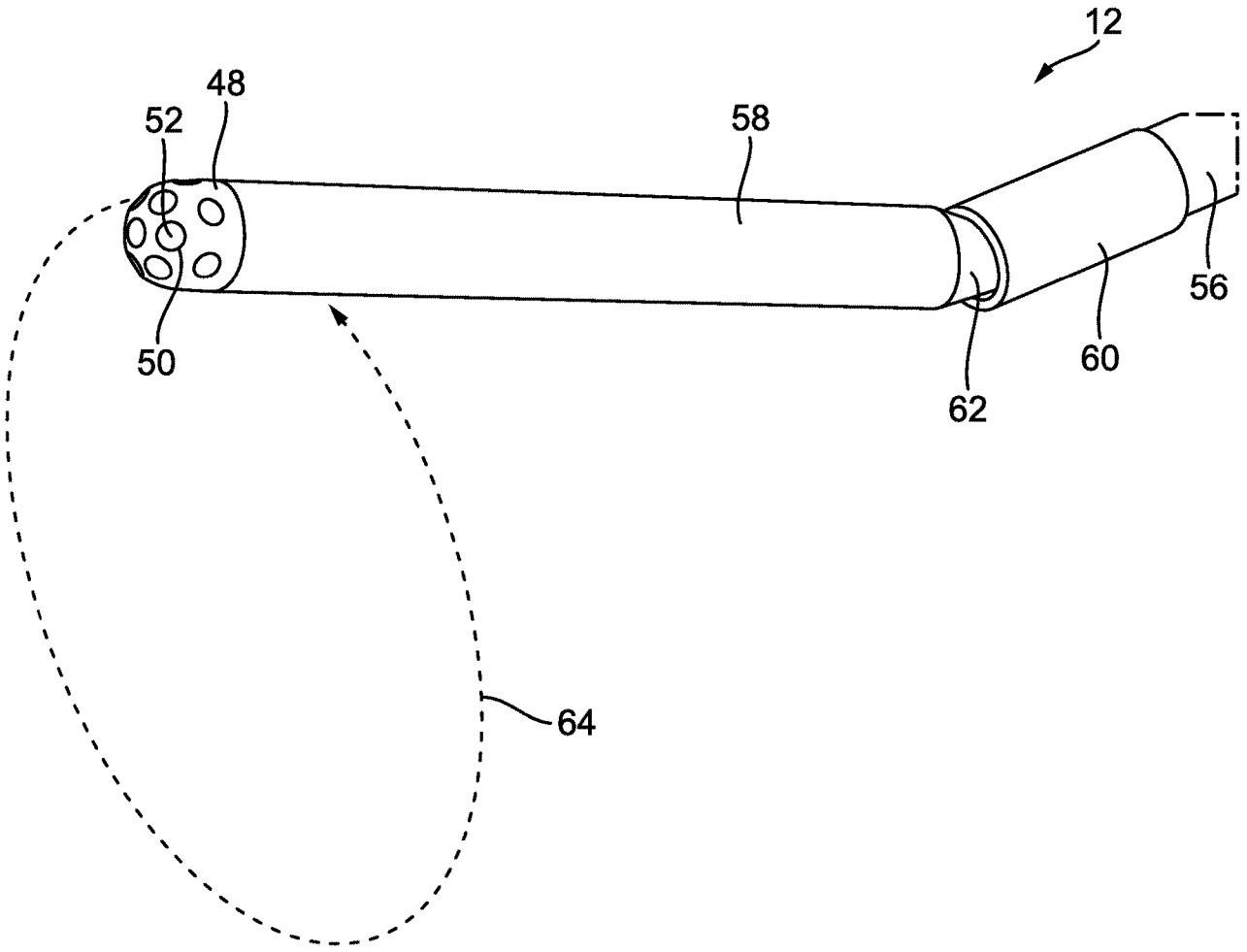
FIG. 8 is a top front side perspective view of the front sensor module having an articulating arm.
Figure 9:
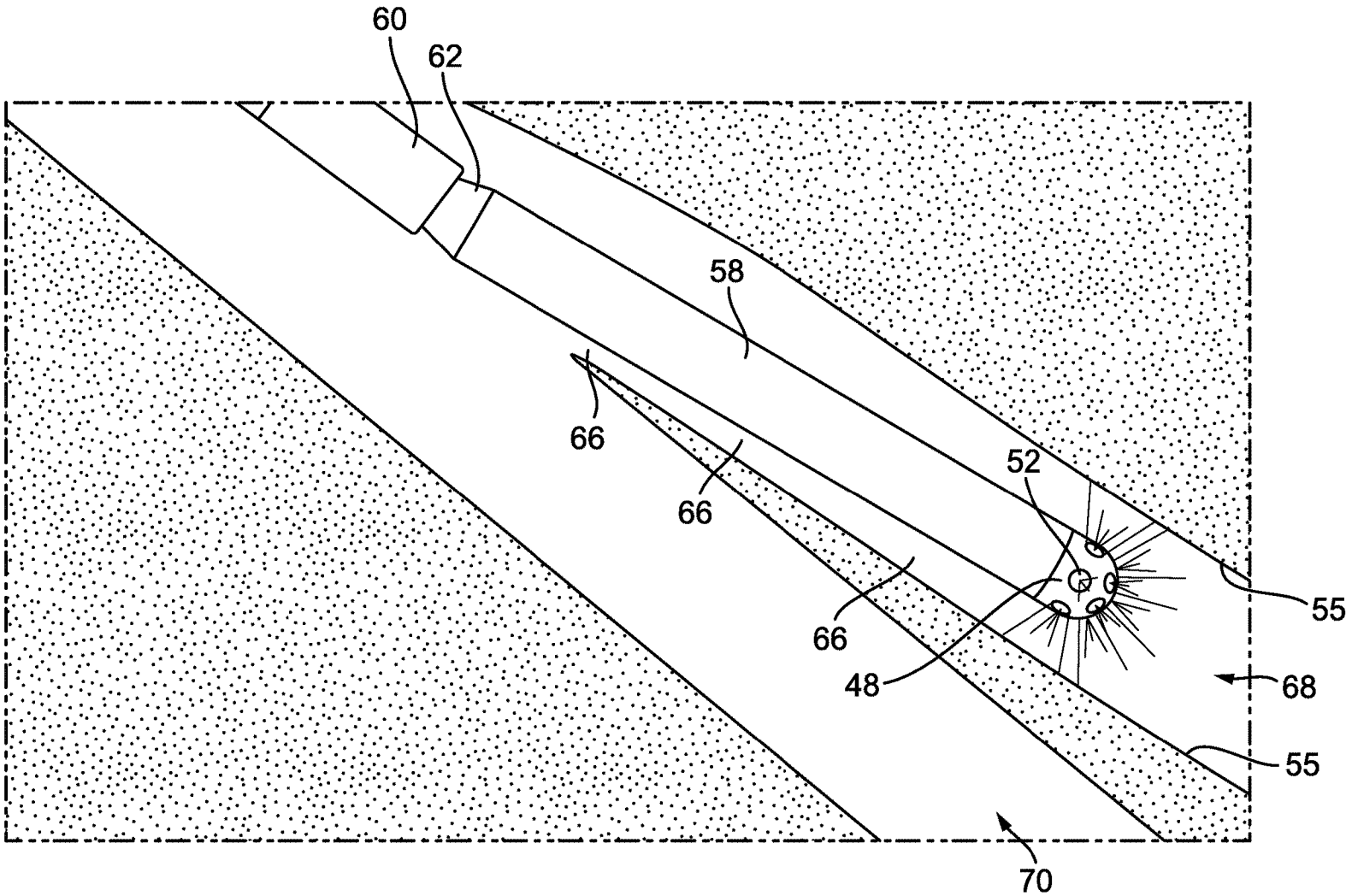
FIG. 9 is a side elevational view of the articulating arm of FIG. 8 moving laterally in a split in a downhole environment.

Referring to FIGS. 8-9, a front end 56 of the front sensor module 12 includes an articulating arm 58. In the illustrated embodiment, the articulating arm 58 is rotatably mounted to the front end 56. For instance, the joint provided for arm rotation can comprise a ball-and-socket member 60. In this construction, the ball-and-socket member 60 has a substantially spherical end 62 of the arm 58 positioned in an opening of the socket of the member 60. Regardless of the particular mounting of the articulated arm 58, it is connected to an actuator 59 which bends the articulating arm 58. In one or more embodiments, a processor associated with the front sensor module 12 executes code which causes the arm to articulate in a direction away from a main bore hole and toward a branching or turning portion of the downhole embodiment. Signals from the sensor 52 are processed by an algorithm, when the mobility platform is in an autonomous operating mode, to select a direction for advancement of the mobility platform. The selected direction can take into consideration the detected characteristics of paths within the downhole environment, including the main bore or a lateral path encountered during transit of the mobility platform 10. The characteristics can include, among other things, the dimensions detected of the main bore and the lateral pathways encountered within the downhole environment, any gases and their respective concentrations, and other sampling of the bore walls, moisture, humidity, temperature or other parameters. As such, the mobility platform 10, as a result of the on-board analysis of the detected signals and information, can continue travel down the main bore or can instead articulate the arm 58 toward a particular lateral direction which has been selected by the algorithm. Accordingly, the sensor module 12 can steer the mobility platform 10 in the selected direction. The actuator 59 includes an internal motor for causing the arm 58 to bend at an angle within a maximum range 64 of angles. For instance, the motor can be part of a solenoid or worm gear which causes the arm to articulate away from the longitudinal axis of the mobility platform 10.

Figure 8B:
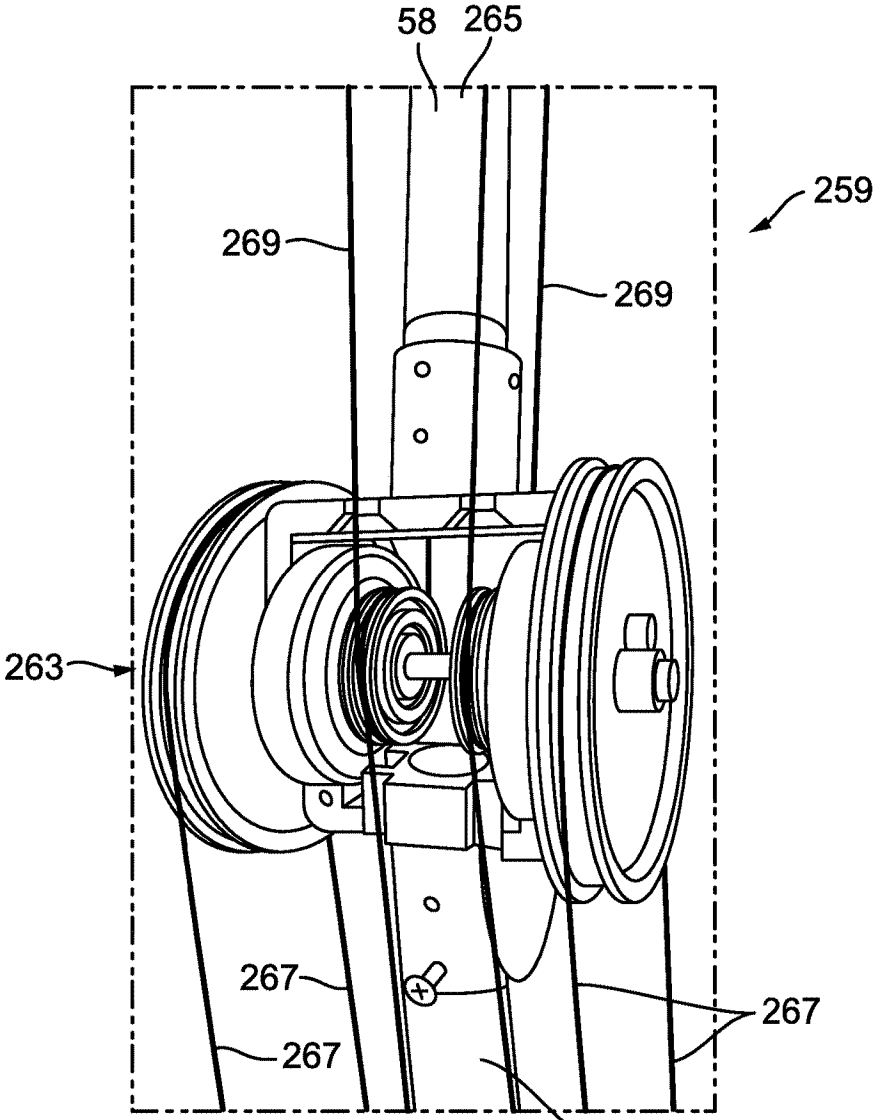
FIG. 8B is a top front side perspective view of another actuator of an articulating arm.
Figure 8A:
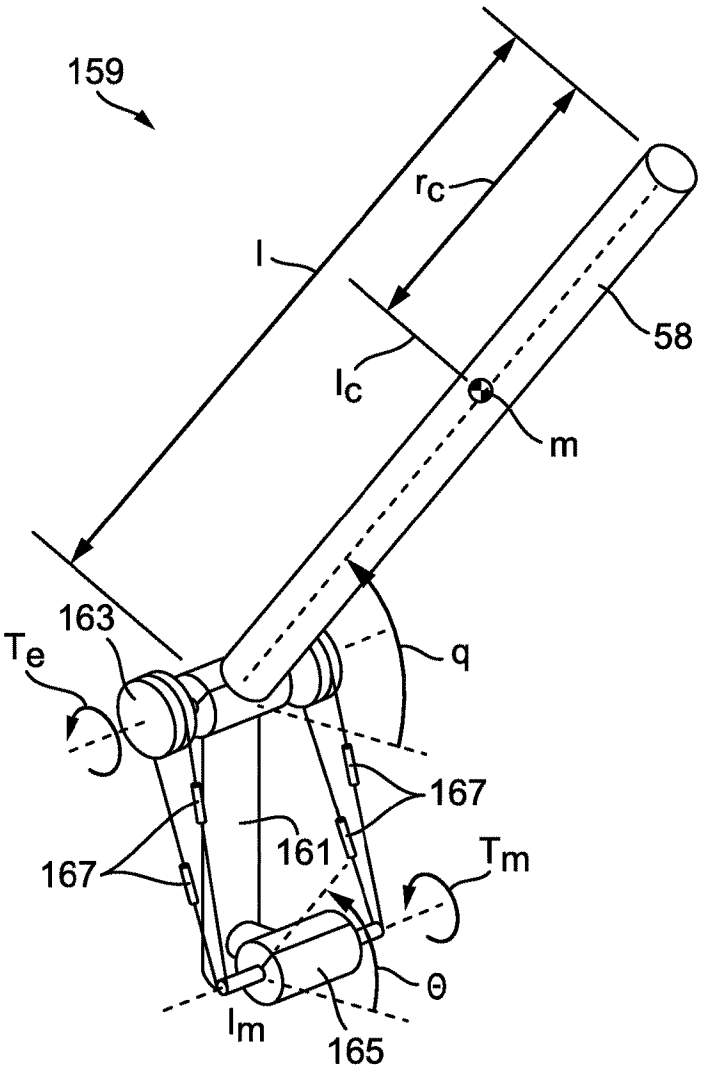
FIG. 8A is a top front side perspective view of an actuator of an articulating arm.

FIGS. 8A-8B illustrate alternative embodiments of the actuator 59. As shown in FIG. 8A, in one embodiment, the actuator 159 can be a one degree of freedom (1-DOF) tendon actuated joint, using push/pull cables and pulleys. In another embodiment, the actuator 159 utilizes an articulating gear arrangement. Referring to FIG. 8A, the actuator 159 includes the arm 58 which can bend at least with an angle q relative to the base 161 in the ball-and-socket member 60 in FIG. 8. A first internal motor 163, acting as a first joint, turns to bend the arm 58 at the selected angle q. A second internal motor 165 selectively pulls the tendons 167 to control and stabilize the bending of the arm 58 about the axis of the first internal motor 163.

As shown in FIG. 8B, in another embodiment, the actuator 259 can have multiple internal motors as joints to provide at least a two degree of freedom (2-DOF) tendon actuated joint. A first motor 263, as a first joint, articulates the arm 58 relative to the base 261 by an angle $q_3$. Another motor acting as a second joint can be located at the end 265 of the arm 58 to articulate relative to the arm 58 by an angle $q_4$. The actuator 259 has one rotational axis that spins about a primary axis, followed by a second degree of freedom that actuates the steering head orthogonally to the primary rotational axis. Tendons 267, 269 control and stabilize the bending of the arm 58 about the axes of the joints, such as the joint 263.

Referring to FIGS. 8A-8B, the internal motors 163, 165, 263 of the actuators 159, 259 are controlled by wireless signals from a nearby computing module, such as the computing module 16. Referring back to FIG. 8, such angular bending of the articulating arm 58 causes the forward tip of the arm 58, with the sensors 52, to move laterally in the selected lateral direction. Referring to FIG. 9, the lateral movement of the arm 58 allows the housing 48 with the sensors 52 to navigate past a split 66 in the downhole environment which enables the mobility platform 10 to enter one path 68 as opposed to another path 70. Accordingly, the front sensor module 12 acts as a navigation module for the mobility platform 10, allowing the drive modules to move the mobility platform 10 in the upcoming portion of the downhole environment in the selected direction.

The present disclosure also includes a system having at least the mobility platform 10 and a control apparatus, such as the external console. The platform 10 is in communication with the control apparatus, for example, by wireless communications from at least one of the computing modules 16, 28. The control apparatus can include a display, a wireless antenna, a control panel, and a hand-held controller mounted in a housing. The housing can be adapted to be a carry case for transporting the control apparatus to a site where the platform 10 is to operate. In an alternative embodiment, the system does not include a control apparatus, and also does not include a tether between the mobility platform 10 and the rig on the surface of the Earth. Accordingly, the mobility platform 10 can be fully autonomous within the downhole environment.

Figure 10:
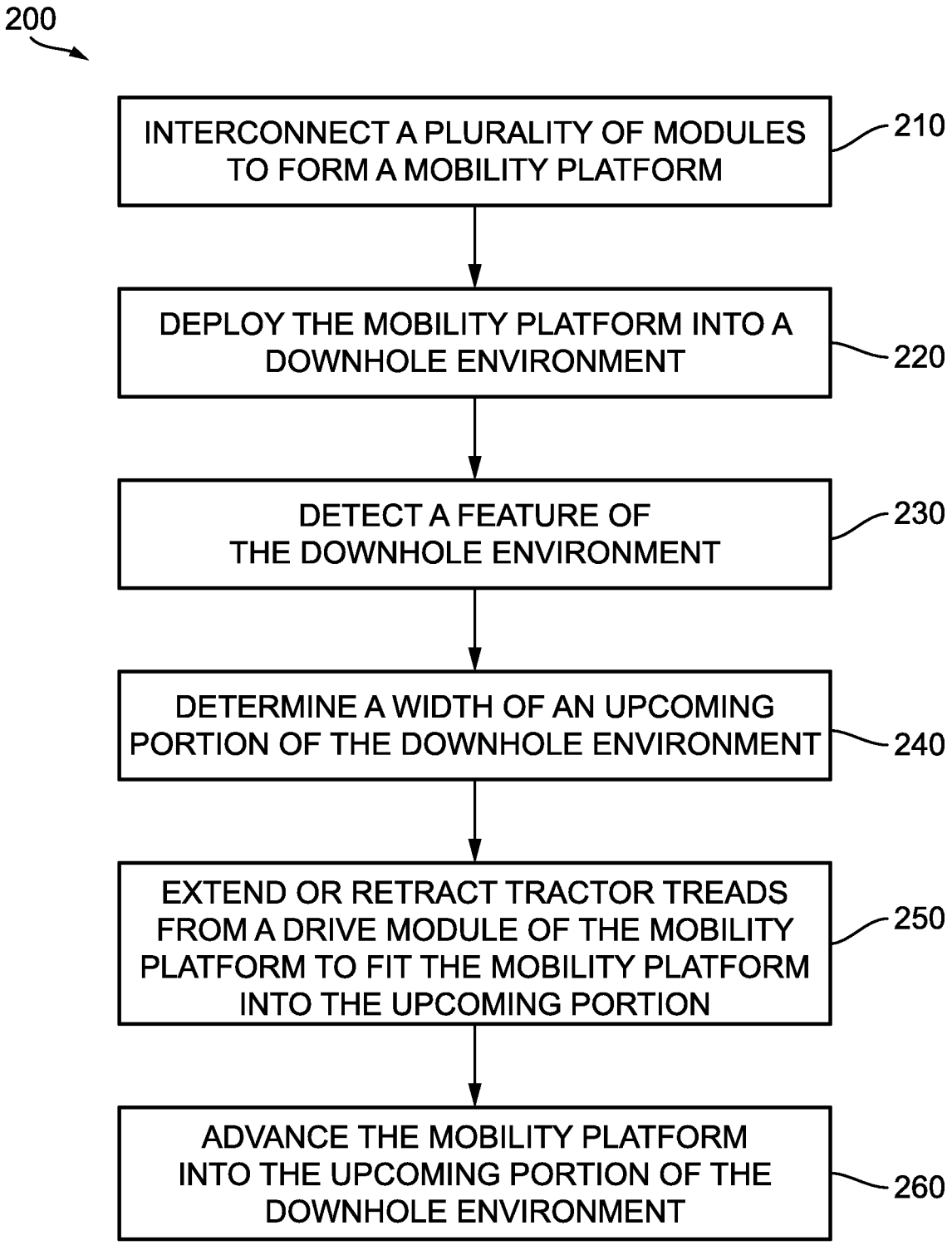
FIG. 10 is a flowchart of a method for operating the mobility platform.

As shown in FIG. 10, the present disclosure also includes a method 200 for operating the mobility platform 10. The method 200 includes the steps of interconnecting a plurality of modules to form the mobility platform 10, including a sensor module, a drive module, and a computing module in step 210. The step of interconnecting can include physically joining discrete modules with a rigid coupling or a joint which allows relative angles to be achieved from one module to a next during traversal of a downhole environment. The physical joining of modules can be a removable coupled. The removable coupling can be established using removable fasteners. Such fasteners can be screws. The screws can removably engage screw holes on opposing surfaces of physically proximate modules to secure the modules together. Alternatively, the removable coupling can be established using complementary surfaces on opposing portions of adjacent modules. The complementary surfaces can secure the adjacent modules together using a friction fit.

The method includes deploying the so-connected modules as a unified mobility platform 10 into a downhole environment in step 220. The deploying can be performed by an operator of a rig on the surface of the Earth. The rig can include the tether 34 attached to the rear sensor module 32 of the mobility platform 10. The operator can manually guide the platform 10 into the downhole. The downhole can be a well. The operator can instruct a rig mechanism to lower the platform 10 into the downhole.

Once the mobility platform 10 is positioned in the downhole environment, the method includes detecting a feature of the downhole environment in step 230 using the front sensor module 12. The front sensor module 12 send a command from a processor executing code to the sensor 52. In response to the command, the sensor 52 emits a sensor signal outward from the front sensor module 12. The sensor signal can be an ultrasonic wave. Alternatively, the sensor signal can be a radio wave. In another alternative embodiment, the sensor signal can be a microwave. The sensor signal is reflected by the feature of the downhole environment. The reflection of the sensor signal is then detected by the sensor 52. In response to the detected reflection, the sensor 52 generates a feature detection signal. The processor of the front sensor module 12 responds to the feature detection signal by sending the feature detection signal to the computing module 16.

The method then proceeds to determining a width of an upcoming portion of the downhole environment in step 240. The determining of the width is performed by a processor executing code in the computing module 16. In response to the feature detection signal, the processor performs a predetermined algorithm using the code to determine the width of the upcoming portion. The predetermined algorithm maps the feature detection signal to a given sensor 52 to generate a map of the upcoming portion with the width.

The method then performs the step of extending or retracting tractor treads from a drive module in step 250 in order to fit the mobility platform 10 within the upcoming portion of the downhole environment. As described above, the tractor treads 44 on the arms 46 are selectively extended or retracted relative to the longitudinal axis of the mobility platform 10. Using the determined width and the map generated in step 240, the computing module 16 selects which tractor treads 44 to be extended or retracted. The selection of tractor treads 44 is performed by a processor executing code in the computing module 16. The processor generates a tractor tread extending command. The tractor tread extending command is transmitted from the computing module 16 to one or more of the drive modules. In response to the tractor tread extending command, a given drive module extends or retracts the tractor treads 44. Each of these steps can be implemented using the modules described above.

The method proceeds with advancing the mobility platform 10 into the upcoming portion of the downhole environment in step 260. As described above, the tractor treads 44 on the arms 46 are selectively preloaded against the walls of the downhole environment. The tractor treads 44 are also selectively driven to move forward or reverse against the walls. The selective driving of the tractor treads 44 is performed by the processor executing code of the computing module 16. The processor generates a tractor tread driving command. The tractor tread driving command is transmitted from the computing module 16 to one or more of the drive modules. In response to the tractor tread driving command, a given drive module drives the tractor treads 44. The driven tractor treads 44 move the associated drive module along the walls of the downhole environment. With associated drive modules moving against the walls, the entire mobility platform 10 moves against the walls. Accordingly, the platform 10 advances into the upcoming portion of the downhole environment.

Portions of the methods described herein can be performed by software or firmware in machine readable form on a tangible (e.g., non-transitory) storage medium. For example, the software or firmware can be in the form of a computer program including computer program code adapted to cause the modular mobility platform to perform various actions described herein when the program is run on a computer or suitable hardware device, and where the computer program can be embodied on a computer readable medium. Examples of tangible storage media include computer storage devices having computer-readable media such as disks, thumb drives, flash memory, and the like, and do not include propagated signals. Propagated signals can be present in a tangible storage media. The software can be suitable for execution on a parallel processor or a serial processor such that various actions described herein can be carried out in any suitable order, or simultaneously.

It is to be further understood that like or similar numerals in the drawings represent like or similar elements through the several figures, and that not all components or steps described and illustrated with reference to the figures are required for all embodiments or arrangements.

The terminology used herein is for the purpose of describing particular embodiments only and is not intended to be limiting of the invention. As used herein, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third) is for distinction and not counting. For example, the use of "third" does not imply there is a corresponding "first" or "second." Also, the phraseology and terminology used herein is for the purpose of description and should not be regarded as limiting. The use of "including," "comprising," "having," "containing," "involving," and variations thereof herein, is meant to encompass the items listed thereafter and equivalents thereof as well as additional items.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims.

The subject matter described above is provided by way of illustration only and should not be construed as limiting. Various modifications and changes can be made to the subject matter described herein without following the example embodiments and applications illustrated and described, and without departing from the true spirit and scope of the invention encompassed by the present disclosure, which is defined by the set of recitations in the following claims and by structures and functions or steps which are equivalent to these recitations

What is claimed is:

1. A mobility platform having a mobility platform longitudinal axis and capable of traveling in a downhole environment, comprising:

a plurality of interconnected modules including at a forward end of the modules a navigation module, wherein the navigation module has a first processor executing first code therein configured to detect a feature of the downhole environment, to generate a data signal corresponding to the detected feature, and to direct the plurality of interconnected modules comprising the mobility platform toward the feature within the downhole environment, the navigation module including:

a front end having a socket;

an articulating arm having a spherical end rotatably mounted in the socket;

a sensor disposed at a forward end of the articulating arm configured to detect the feature of the downhole environment; and an actuator connected to bend the articulating arm in a selected lateral direction;

a first drive module among the plurality of interconnected modules, the first drive module having a first drive module longitudinal axis coincident with the mobility platform longitudinal axis, and three first tractor treads spaced 120 degrees apart from each other about the first drive module longitudinal axis, with the three first tractor treads extendable radially out from the first drive module longitudinal axis, and retractable radially in towards the first drive module longitudinal axis;

a second drive module among the plurality of interconnected modules, the second drive module having a second drive module longitudinal axis coincident with the mobility platform longitudinal axis, and three second tractor treads spaced 120 degrees apart from each other about the second drive module longitudinal axis, with the three second tractor treads extendable radially out from the second drive module longitudinal axis, and retractable radially in towards the second drive module longitudinal axis, and wherein the three second tractor treads are rotated by a non-zero angle about the mobility platform longitudinal axis to be spaced by the non-zero angle relative to the three first tractor treads; and a computing module among the plurality of interconnected modules, the computing module having a computing housing disposed along the mobility platform longitudinal axis between the first and second drive modules, the computing module having a second processor within the computing housing and executing second code therein configured, responsive to the data signal, to determine a first width of an upcoming portion of the downhole environment;

wherein the computing module is further configured to:

control the first and second drive modules using a first wireless signal sent to the first and second drive modules to extend or retract the three first tractor treads spaced 120 degrees apart from each other about the first drive module longitudinal axis, and to extend the three second tractor treads spaced 120 degrees apart from each other about the second drive module longitudinal axis, with the three first tractor treads extendable or retractable radially out from or in towards the first drive module longitudinal axis, respectively, and with the three second tractor treads extendable or retractable radially out from or in towards the second drive module longitudinal axis, respectively, to have each of the first and second drive modules configured with a second width less than a first width to fit the mobility platform in the upcoming portion in the selected lateral direction, and control the first and second drive modules using a second wireless signal sent to the first and second drive modules to drive the first and second tractor treads, respectively, to move the mobility platform in the upcoming portion in the selected lateral direction.

2. The mobility platform of claim 1, wherein the navigation module, the computing module, and the first and second drive modules are linearly interconnected.

3. The mobility platform of claim 2, wherein the navigation module, the computing module, and the first and second drive modules are removably interconnected.

4. The mobility platform of claim 1, wherein each of the navigation module, the computing module, and the first and second drive modules have housings that are substantially cylindrical with a respective module longitudinal axis.

5. The mobility platform of claim 4, wherein the navigation module, the computing module, and the first and second drive modules are interconnected with the respective module longitudinal axes substantially aligned to form the mobility platform and to define a substantially cylindrical shape along a mobility platform longitudinal axis.

6. The mobility platform of claim 5, wherein the first and second tractor treads are extended or retracted radially relative to the mobility platform longitudinal axis.

7. The mobility platform of claim 1, wherein the sensor emits a detection signal in a forward direction for detecting the feature.

8. The mobility platform of claim 7, wherein the detection signal includes ultrasonic waves.

9. The mobility platform of claim 1, wherein the non-zero angle is 60 degrees.

10. A mobility platform having a mobility platform longitudinal axis and capable of traveling in a downhole environment, comprising:

a plurality of interconnected modules including at a forward end of the modules a navigation module, wherein the navigation module has a first processor executing first code therein configured to detect a feature of the downhole environment, to generate a data signal corresponding to the detected feature, and to direct the plurality of interconnected modules comprising the mobility platform toward the feature within the downhole environment, the navigation module including:

a front end having a socket;

an articulating arm having a spherical end rotatably mounted in the socket;

a sensor disposed at a forward end of the articulating arm configured to detect the feature, and an actuator connected to bend the articulating arm in a selected lateral direction;

a first drive module among the plurality of interconnected modules, the first drive module having a first drive module longitudinal axis coincident with the mobility platform longitudinal axis, and three first retractable tractor treads spaced 120 degrees apart from each other about the first drive module longitudinal axis, with the three first tractor treads extendable radially out from the first drive module longitudinal axis, and retractable radially in towards the first drive module longitudinal axis;

a second drive module among the plurality of interconnected modules, the second drive module having a second drive module longitudinal axis coincident with the mobility platform longitudinal axis, and three second retractable tractor treads spaced 120 degrees apart from each other about the second drive module longitudinal axis, with the three second tractor treads extendable radially out from the second drive module longitudinal axis, and retractable radially in towards the second drive module longitudinal axis, and wherein the three second tractor treads are rotated by a non-zero angle about the mobility platform longitudinal axis to be spaced by the non-zero angle relative to the three first tractor treads; and a computing module among the plurality of interconnected modules, the computing module having a computing housing disposed along the mobility platform longitudinal axis between the first and second drive modules, the computing module having a second processor executing second code therein configured, responsive to the data signal, to determine a first width of an upcoming portion in the selected direction; and wherein the computing module is further configured to:

control the actuator to bend the articulating arm in the selected lateral direction to direct the articulating arm toward the upcoming portion of the downhole environment, control the first and second drive modules using a first wireless signal sent to the first and second drive modules to extend or retract the three first tractor treads spaced 120 degrees apart from each other about the first drive module longitudinal axis, and to extend or retract the three second tractor treads spaced 120 degrees apart from each other about the second drive module longitudinal axis, respectively, with the three first tractor treads extendable or retractable radially out from or in towards the first drive module longitudinal axis, respectively, and with the three second tractor treads extendable or retractable radially out from or in towards the second drive module longitudinal axis, respectively, to have each of the first and second drive modules configured with a second width less than a first width to fit the mobility platform in the upcoming portion in the selected direction, and control the first and second drive modules using a second wireless signal sent to the first and second drive modules to drive the first and second tractor treads, respectively, to move the mobility platform in the upcoming portion in the selected direction.

11. The mobility platform of claim 10, wherein the sensor emits a detection signal in the lateral direction for detecting the feature.

12. The mobility platform of claim 11, wherein the detection signal includes ultrasonic waves.

13. The mobility platform of claim 10, wherein the navigation module, the computing module, and the first and second drive modules are linearly interconnected.

14. The mobility platform of claim 13, wherein the navigation module, the computing module, and the first and second drive modules are removably interconnected.

15. The mobility platform of claim 10, wherein each of the navigation module, the computing module, and the first and second drive modules have housings that are substantially cylindrical with a respective module longitudinal axis.

16. The mobility platform of claim 15, wherein the navigation module, the computing module, and the first and second drive modules are interconnected with the respective module longitudinal axes substantially aligned to form the mobility platform and to define a substantially cylindrical shape along a mobility platform longitudinal axis.

17. The mobility platform of claim 16, wherein the tractor treads are extended or retracted radially relative to the mobility platform longitudinal axis.

18. The mobility platform of claim 10, wherein the non-zero angle is 60 degrees.

19. A method, comprising:

interconnecting a plurality of modules to be a mobility platform having a mobility platform longitudinal axis, the plurality of modules including a computing module, a first drive module, a second drive module, and, at a forward end of the modules, a navigation module, wherein the navigation module has a first processor executing first code therein configured to detect a feature of the downhole environment, to generate a data signal corresponding to the detected feature, and to direct the plurality of interconnected modules comprising the mobility platform toward the feature with the downhole environment, the navigation module including a front end having a socket, an articulating arm having a spherical end rotatably mounted in the socket, a sensor disposed at a forward end of the articulating arm configured to detect the feature, and an actuator connected to bend the articulating arm in a selected lateral direction, wherein the computing module having a second processor executing second code therein configured, responsive to the data signal, to determine a first width of an upcoming portion in the selected direction, wherein the first drive module has a first drive module longitudinal axis coincident with the mobility platform longitudinal axis, and three first tractor treads spaced 120 degrees apart from each other about the first drive module longitudinal axis, with the three first tractor treads extendable radially out from the first drive module longitudinal axis, and retractable radially in towards the first drive module longitudinal axis, wherein the second drive module has a second drive module longitudinal axis coincident with the mobility platform longitudinal axis, and three second tractor treads spaced 120 degrees apart from each other about the second drive module longitudinal axis, with the three second tractor treads extendable radially out from the second drive module longitudinal axis, and retractable radially in towards the second drive module longitudinal axis, wherein the three second tractor treads are rotated by a non-zero angle about the mobility platform longitudinal axis to be spaced by the non-zero angle relative to the three first tractor treads, wherein the computing module has a computing housing disposed along the mobility platform longitudinal axis between the first and second drive modules, wherein the computing module is further configured to control the first and second drive modules using a first wireless signal sent to the first and second drive modules to extend or retract the three first tractor treads spaced 120 degrees apart from each other about the first drive module longitudinal axis, and to extend or retract the three second tractor treads spaced 120 degrees apart from each other about the second drive module longitudinal axis, with the three first tractor treads extendable or retractable radially out from or in towards the first drive module longitudinal axis, respectively, and with the three second tractor treads extendable or retractable radially out from or in towards the second drive module longitudinal axis, respectively, to have each of the first and second drive modules configured with a second width less than the first width to fit the mobility platform in the upcoming portion in the selected direction, and control the first and second drive modules using a second wireless signal sent to the first and second drive modules to drive the first and second tractor treads to move the mobility platform in the upcoming portion in the selected direction;

deploying the mobility platform into the downhole environment;

detecting the feature of the downhole environment;

determining the first width of the upcoming portion of the downhole environment;

moving a first or second tractor tread of the first or second drive module, respectively, to fit the mobility platform into the upcoming portion; and advancing the mobility platform into the upcoming portion of the downhole environment.

20. The method of claim 19, wherein the moving the first and second tractor treads comprises either extending the first and second from the first and second drive modules, respectively, or retracting the first and second tractor treads toward the first and second drive modules, respectively, prior to advancing the mobility platform into the upcoming portion of the downhole environment.

* * * * *